US005216642A

United States Patent [19]

Rikkers

[11] Patent Number: 5,216,642

[45] Date of Patent: Jun. 1, 1993

[54] SPORTS COLLECTORS CLOCK

[76] Inventor: Henry D. Rikkers, 311 2nd Ave., SE., Sioux Center, Iowa 51250

[21] Appl. No.: 723,771

[22] Filed: Jul. 1, 1991

[51] Int. Cl.[5] ..... G04B 21/00

[52] U.S. Cl. ..... 368/10; 368/228; 368/274; 368/276; 368/278

[58] Field of Search ..... 368/10, 223-240, 368/272-276, 278

[56] References Cited

U.S. PATENT DOCUMENTS

| | | | |
|---|---|---|---|
| 3,419,989 | 1/1969 | Booty | 368/229 |
| 3,959,814 | 5/1976 | Howard | 368/271 |
| 4,498,787 | 2/1985 | Jung-Sun | 368/10 |
| 4,502,788 | 3/1985 | Lowden | 368/10 |

*Primary Examiner*—Bernard Roskoski
*Attorney, Agent, or Firm*—Leon Gilden

[57] ABSTRACT

A clock assembly includes an enlarged planar support face for receiving a first picture thereon, wherein a secondary support surface within the first support surface mounts a secondary picture, with the clock member projecting through the first support surface and a perimeter frame work projecting forwardly of each support surface for directing visual attention therewithin. A modification of the invention includes removable dials mounted to the clock to permit mounting of clock hands with appropriate symbology relative to desired sports figures. Further, a modification of the invention provides for enclosed pocket structure for mounting and receiving a secondary picture therewithin.

1 Claim, 4 Drawing Sheets

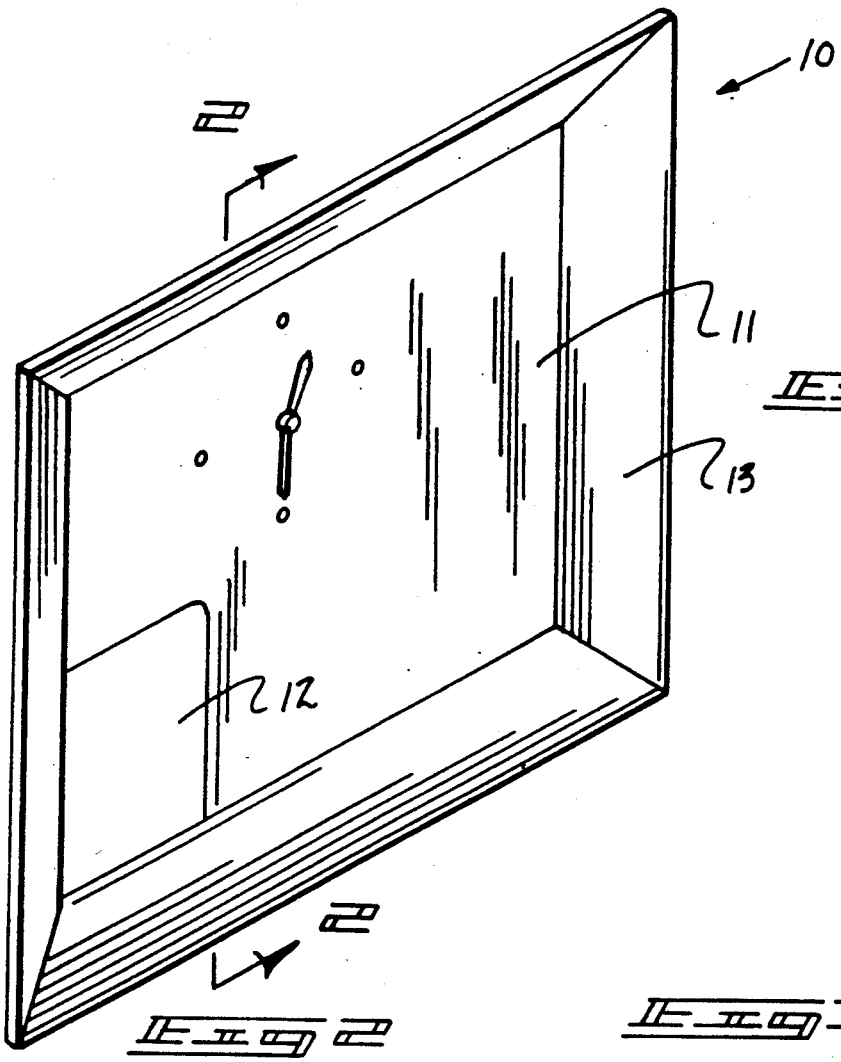
Fig 1
Fig 2
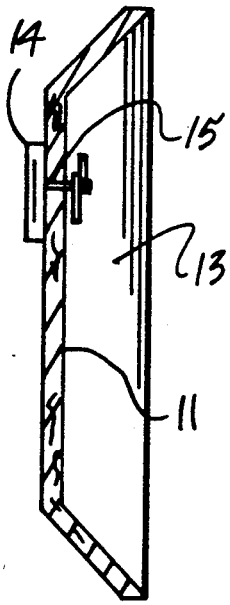
Fig 3
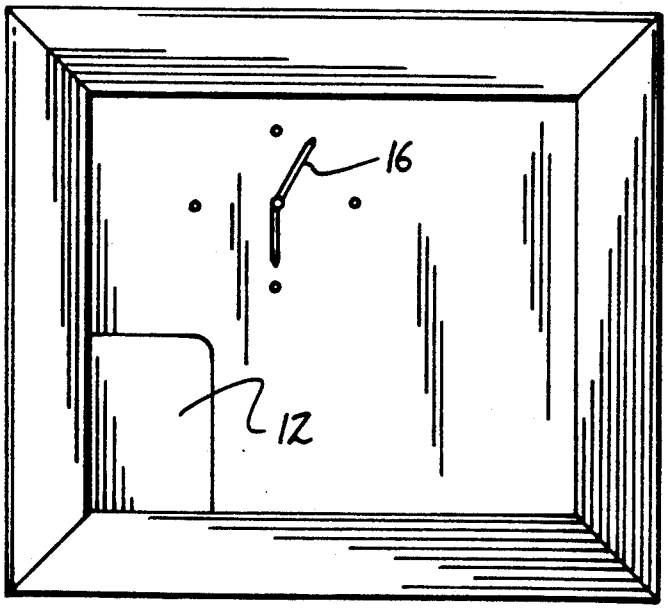

10a
13
20
16a
11

24
23
5
PLAY BELL
12
5
21
11
22
23
20
19
18
20
19
18
20
19
18

SPORTS COLLECTORS CLOCK

BACKGROUND OF THE INVENTION

1. Field of the Invention

The field of invention relates to clock and display apparatus, and more particularly pertains to a new and improved sports collector clock wherein the same is arranged for providing visual presentation of sports figures within a containerized clock assembly.

2. Description of the Prior Art

The mounting and presentation of various sports figures is of contemporary popularity and associated display of such sports figures is desirable in the hobbyist or enthusiastic sports fan. The present invention sets forth a clock assembly construction wherein the same provides an elongate planar surface for mounting a picture of a sports figure therewithin, with a secondary surface arranged for mounting various secondary display of the sports figure.

Prior art structure has in the past provided basic rudimentary mounting for display of various sporting figures and the like within typical frameworks for mounting upon horizontal or vertical support surfaces in a contemporary manner such as with subject pictures and the like. The instant invention attempts to overcome deficiencies of such prior art practice by providing a framework and associated structure for emphasizing a particular sporting event and figure associated therewith.

As such, it may be appreciated that there continues to be a nee d for a new and improved sports collectors clock as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of clock apparatus now present in the prior art, the present invention provides a sports collectors clock wherein the same is arranged for the visual presentation of sporting events and/or figures therewith. As such, the general purpose of the present invention, which will be described subsequently in greater detail, is to provide a new and improved sports collectors clock which has all the advantages of the prior art clock apparatus and none of the disadvantages.

To attain this, the present invention provides a clock assembly including an enlarged planar support face for receiving a first picture thereon, wherein a secondary support surface within the first support surface mounts a secondary picture, with the clock member projecting through the first support surface and a perimeter frame work projecting forwardly of each support surface for directing visual attention therewithin. A modification of the invention includes removable dials mounted to the clock to permit mounting of clock hands with appropriate symbology relative to desired sports figures. Further, a modification of the invention provides for enclosed pocket structure for mounting and receiving a secondary picture therewithin.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application The abstract is neither intended to define the invention of the application, which is measured by the claims, nor is it intended to be limiting as to the scope of the invention in any way.

It is therefore an object of the present invention to provide a new and improved sports collectors clock which has all the advantages of the prior art clock apparatus and none of the disadvantages.

It is another object of the present invention to provide a new and improved sports collectors clock which may be easily and efficiently manufactured and marketed.

It is a further object of the present invention to provide a new and improved sports collectors clock which is of a durable and reliable construction.

An even further object of the present invention is to provide a new and improved sports collectors clock which is susceptible of a low cost of manufacture with regard to both materials and labor, and which accordingly is then susceptible of low prices of sale to the consuming public, thereby making such sports collectors clock economically available to the buying public.

Still yet another object of the present invention is to provide a new and improved sports collectors clock which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic view, taken along the lines 2—2 of FIG. 1 in the direction indicated by the arrows.

FIG. 3 is an orthographic frontal view, taken in elevation, of the invention.

DESCRIPTION OF THE PREFERRED EMBODIMENT

Figures 4, 5, 6:
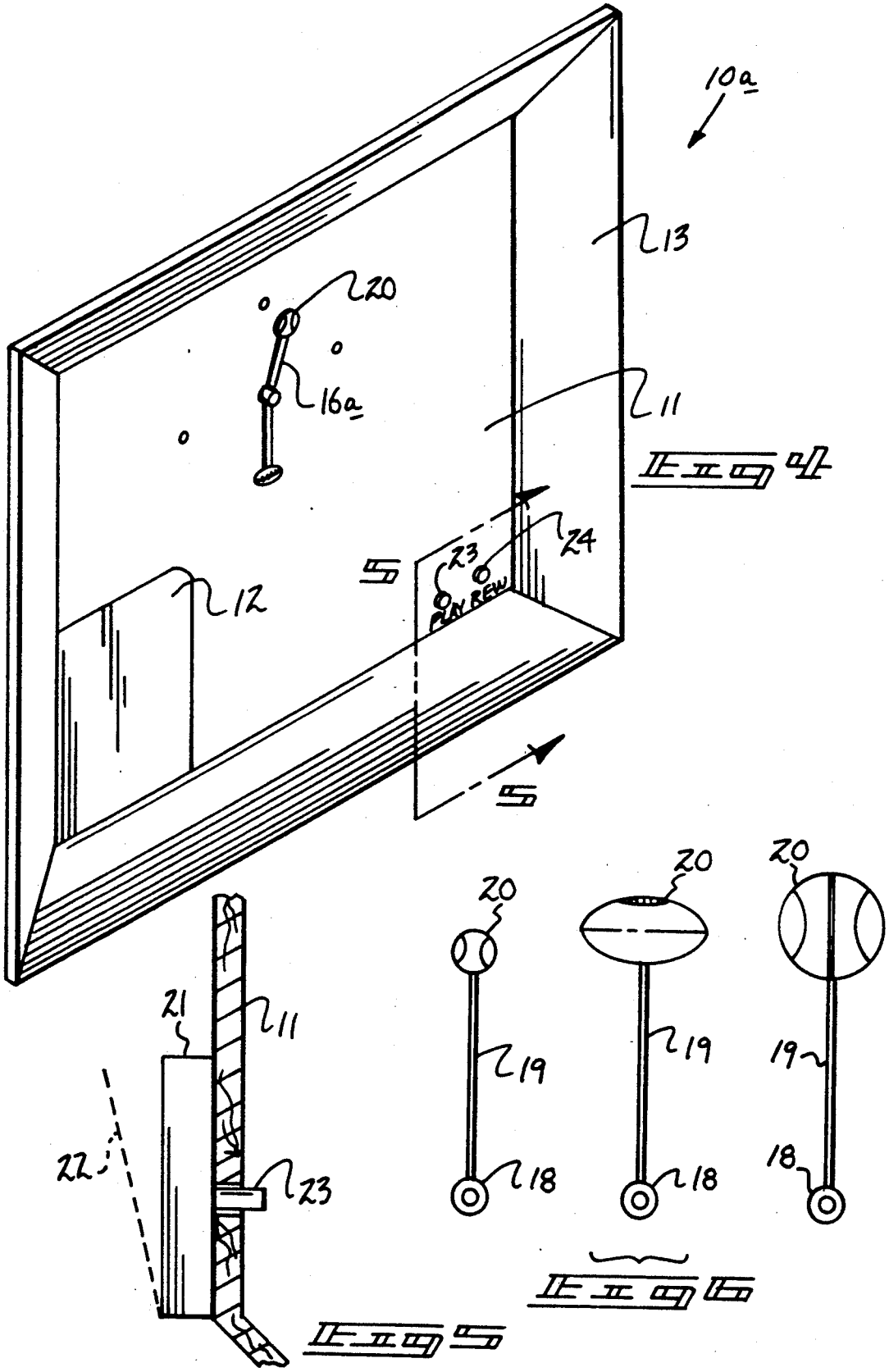
FIG. 4 is an isometric illustration of a modification of the invention.
FIG. 5 is an orthographic view, taken along the lines 5—5 of FIG. 4 in the direction indicated by the arrows.
FIG. 6 is an orthographic illustration of further clock indicator hands utilized by the invention.

With reference now to the drawings, and in particular to FIGS. 1 to 10 thereof, a new and improved sports collectors clock embodying the principles and concepts of the present invention and generally designated by the reference numeral 10 will be described.

More specifically, the sports collectors clock 10 of the invention essentially comprises a clock apparatus including a planar mounting surface 11 for receiving a pictorial representation of a sports figure or event thereon, with a secondary planar mounting surface 12 positioned in a corner portion of the primary mounting surface 11. A perimeter framework 13 projects forwardly of the primary and secondary planar surfaces 11 and 12 and is formed of a continuous assemblage of trapezoidal flanges secured together. A clock mechanism 14 mounted to a rear surface of the primary planar mounting surface 11 includes a clock shaft 15 projecting orthogonally through the primary mounting surface 11, with a plurality of clock hand members 16 mounted to a forward end of the clock mechanism projecting about the forward mounting surface. FIG. 6 illustrates the use of replacement clock indicator hands 16*a*, wherein each of the modified hand members 16*a* includes a mounting cylinder 18 fixedly mounted to a lower terminal end of a rod 19 for selective securement about the clock shaft 15. A sports representation enlarged head portion 20 is mounted at a upper end of each of the rods 19 formed of varying designations, such as baseball, football, basketball, and the like for associating the clock structure with the pictorial representation, as noted above.

Further, an audio tape player 21 mounted to a rear surface of the primary mounting surface 11 includes a plurality of buttons including a start button 23 and a rewind button 24 projecting through the primary mounting surface 11 below the clock mechanism, with the audio tape player 21 including an access door 22 pivotally mounted rearwardly of the primary mounting surface 11 to receive various audio cassettes associating an audio representation in association with a pictorial representation presented upon the primary and secondary mounting surface. The modification 10*a*, as illustrated in FIG. 4 for example, thereby constructively associates the clock mechanism with any pictorial representation and audio signal desired by an individual sports enthusiast.

Figure 7:
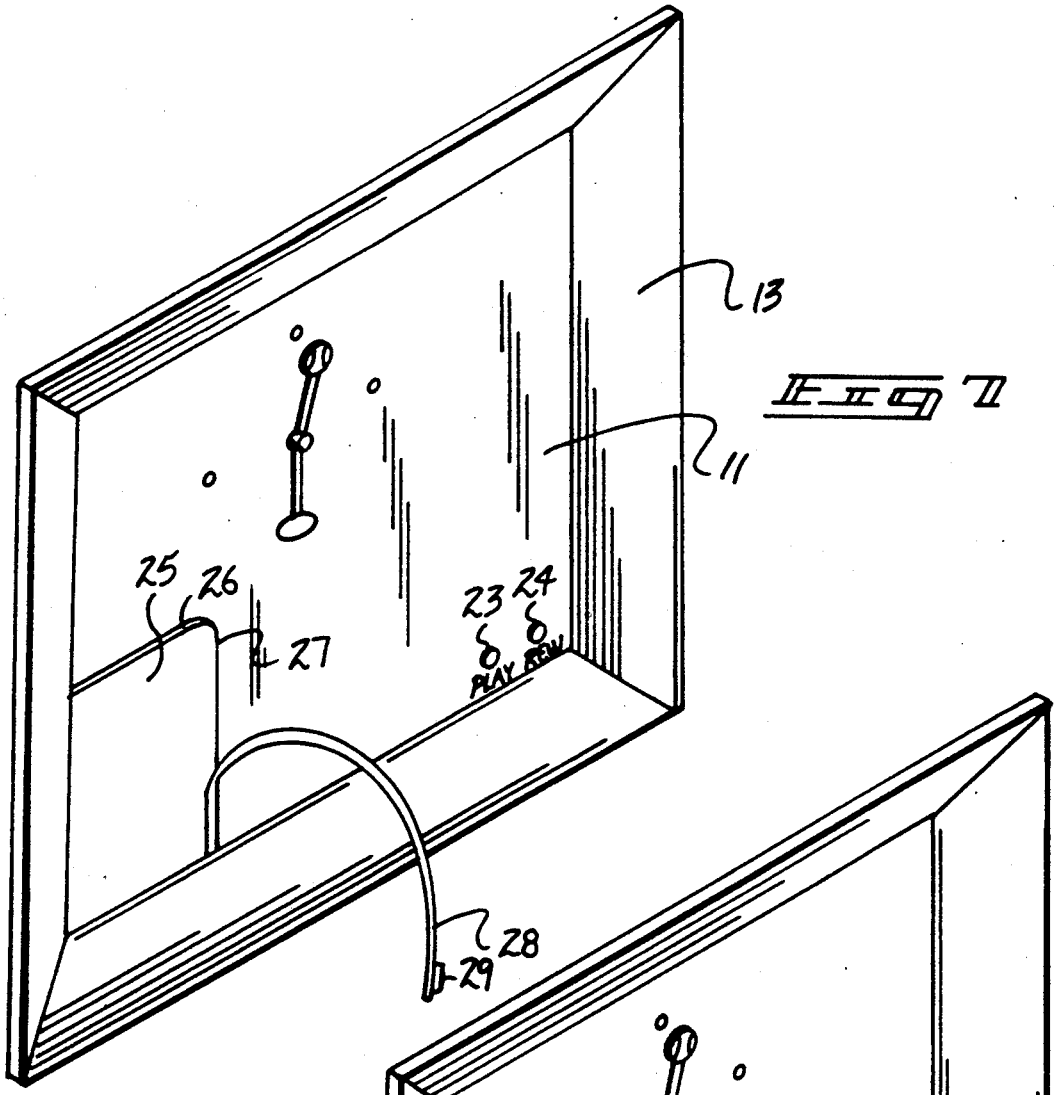
FIG. 7 is an isometric illustration of the invention utilizing modified pocket structure.
Figure 8:
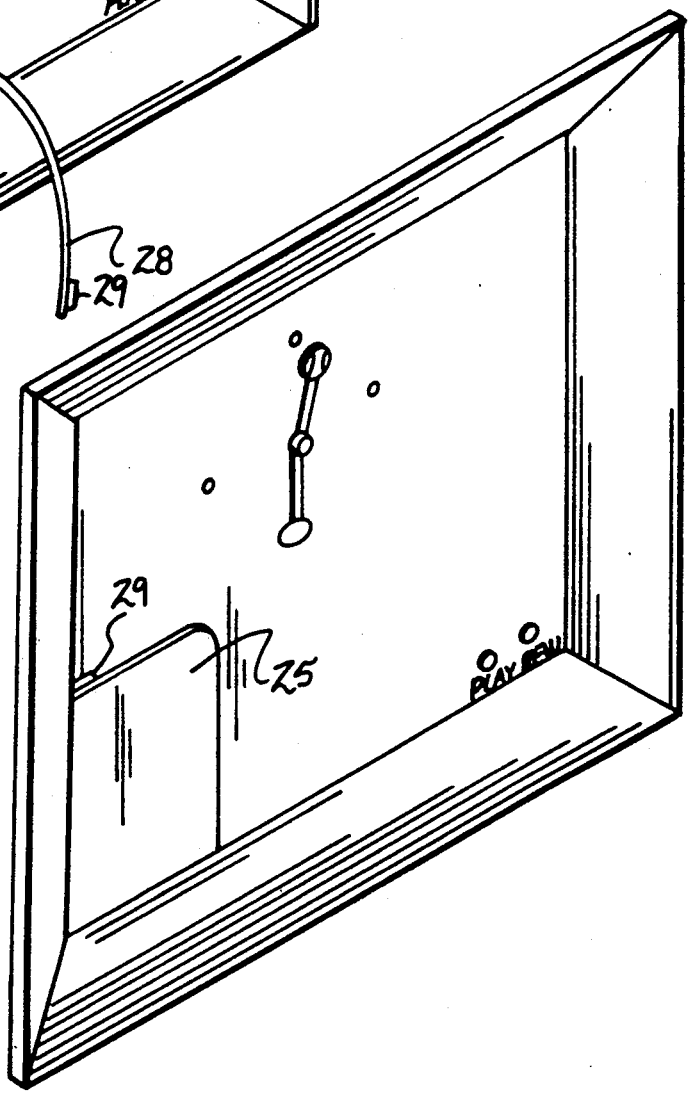
FIG. 8 is an isometric illustration of the modified pocket structure in an assembled configuration.

The secondary mounting surface 12, as illustrated and modified in representations FIGS. 7 and 8, includes a transparent pocket window 25, with a continuous opening defined by a top opening 26 and a side opening 27 to receive a photograph and the like within the pocket structure between the transparent pocket window 25 and the secondary planar mounting surface 12. A cylindrical resilient seal 28 is subsequently received within the top and side openings 26 and 27, with a manual grasping tab 29 mounted at an upper terminal end of the seal and with the lower end of the seal fixedly mounted to the primary mounting surface 11 to provide an enclosure to protect various cards and the like positioned within the pocket structure.

Figure 9:
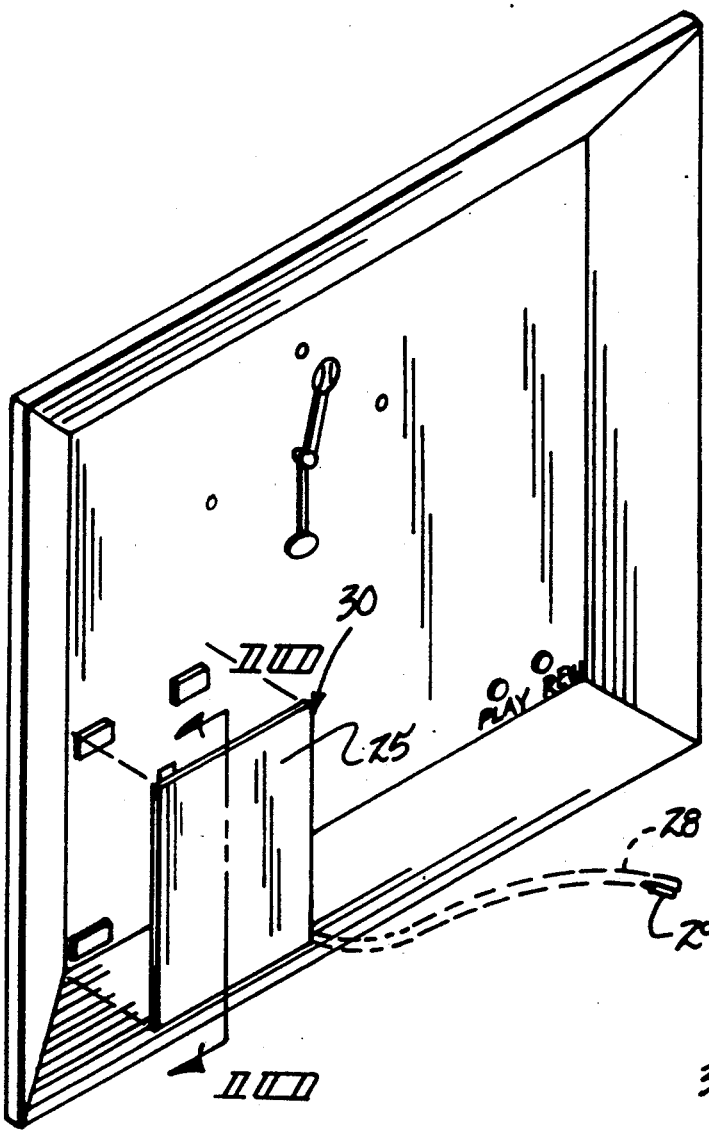
FIG. 9 is an isometric illustration of a further modification of the invention utilizing further modified pocket structure.
Figure 10:
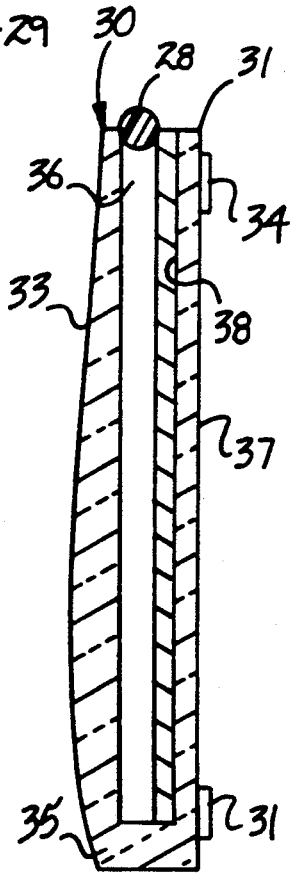
FIG. 10 is an orthographic view, taken along the lines 10—10 of FIG. 9 in the direction indicated by the arrows.

FIGS. 9 and 10 illustrate a further modified collectors clock structure 10*b*, wherein a modified pocket member 30 includes a transparent window rear plate 31 defined by a rear window plate planar rear wall 37 spaced from a planar rear window plate inclined forward wall 38. The forward wall 38 is inclined and sloped rearwardly relative to the rear wall 37 extending from a lower terminal end of the forward wall 38 to an upper end thereof to provide a rearwardly inclined forward surface inclined rearwardly relative to the rear wall 37 to provide enhance support for a picture presented within a pocket cavity 36 defined between the forward wall 38 and a transparent convex magnification viewing lens 33. The viewing lens 33 and the rear plate 31 are each fixedly mounted to a transparent support base 35. Further, a plurality of peel-away adhesive pads 34 typically formed of transparent adhesive material are mounted to the rear wall 37. In this manner, when a picture is positioned within the pocket member 30, viewing of the surface rearwardly of the pocket member is available.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sports collectors clock, comprising, a primary planar mounting plate, including a forward primary surface and a rear primary surface, the forward primary surface including a secondary planar mounting surface contained therewithin, and a perimeter framework fixedly mounted to a perimeter of the primary plate projecting forwardly thereof, and a clock mechanism mounted to the primary rear surface, with the clock member including a shaft orthogonally projecting through the primary plate, and the primary shaft including a forward terminal end positioned beyond the primary forward surface, and a plurality of clock indicator hand members mounted to the forward terminal end of the clock shaft, and the plurality of indicator hand members are removably mounted relative to the clock shaft, and each of the indicator members including a mounting rod, the mounting rod including a lower terminal end, the lower terminal end including a mounting cylinder for securement to the clock shaft, and the mounting rod including a rod upper terminal end, the rod upper terminal end including a sports representative enlarged head mounted to the rod upper terminal end, and an audio tape player is mounted to the primary rear surface of the primary plate, the audio tape player arranged for audio playing of representative sporting representations, and a plurality of operational buttons in operative communication with the tape player projecting through the primary plate, and the secondary planar mounting surface includes a transparent window rear plate, the transparent window rear plate includes a window rear surface and a window forward surface, the window forward surface inclined rearwardly relative to the window rear surface, and a convex transparent magnification viewing lens spaced from the window rear plate, and the viewing lens and the rear plate mounted to a transparent support base, and the rear surface including a plurality of transparent adhesive strips for securement of the window rear plate to the secondary planar mounting surface, and an elongate resilient seal removably mounted between the window rear plate and the viewing lens at a spacing defined between a window rear plate upper terminal end and a viewing lens upper terminal end, wherein the rear plate and the viewing lens are coextensive relative to one another.

* * * * *